United States Patent [19]

Burtley

[11] 4,036,336

[45] July 19, 1977

[54] WHEELED SUITCASE CONVERTIBLE TO LUGGAGE CART

[76] Inventor: Oscar L. Burtley, Box 4, Rte. 3, Lake Land Hills, Carbondale, Ill. 62901

[21] Appl. No.: 670,279

[22] Filed: Mar. 25, 1976

[51] Int. Cl.[2] ..... A45C 5/14

[52] U.S. Cl. ..... 190/18 A; 190/58 B

[58] Field of Search ..... 190/18 R, 18 A, 58 B; 280/37, 47.26, 47.27, 43.37

[56] References Cited

U.S. PATENT DOCUMENTS

| | | | |
|---|---|---|---|
| 2,416,752 | 3/1947 | Hendrick | 190/18 A X |
| 2,510,754 | 6/1950 | Norlin | 190/18 A UX |
| 2,581,417 | 1/1952 | Jones | 190/18 A X |
| 2,925,283 | 2/1960 | Stilger | 190/18 A X |
| 3,606,372 | 5/1969 | Browning | 190/18 A X |
| 3,924,872 | 12/1975 | Sollazzi | 190/18 A X |
| 3,946,839 | 3/1976 | Butler | 190/18 A |

FOREIGN PATENT DOCUMENTS

| | | | |
|---|---|---|---|
| 59,346 | 1/1954 | France | 190/18 A |

*Primary Examiner*—Donald F. Norton
*Attorney, Agent, or Firm*—Grace J. Fishel

[57] ABSTRACT

A suitcase having rolling means at the bottom is provided with a retractable handle including a pair of longitudinally extendable tubes connected to a sidewall of the suitcase at their proximal ends and connected at their distal ends to a cross-member forming a grip, said tubes received in retracted position within said sidewall. In extended position, said tubes in combination with the top of the suitcase providing a luggage supporting surface for additional pieces of luggage. The suitcase further having a pair of pivotal support arms attached to the bottom of the suitcase which in extended position provide an additional luggage supporting surface.

7 Claims, 5 Drawing Figures

WHEELED SUITCASE CONVERTIBLE TO LUGGAGE CART

This invention relates to a suitcase having rolling means on the bottom which in collapsed condition can be hand carried like an ordinary suitcase and in extended condition can be used as a luggage cart to carry other pieces of luggage.

There have been various suitcases proposed to make luggage handling easier for the traveler. Many of these suitcases have included rollers and a pull strap so that the traveler can pull the bag alongside of him. These suitcases are satisfactory when the traveler has one bag but when he has more luggage, he must either carry the additional pieces or drag several suitcases. If he carries the additional cases, he may fatigue and have to stop and rest from time to time. If he drags several of them, he may have difficulty passing through crowds or down narrow passageways.

There have also been portable luggage carts proposed in the past for hauling several pieces of luggage. Most of these carts, however, when not in use are carried in a case, thus making for still another piece of luggage to burden the traveler. When needed, they must be taken out of the case, set up and attached to the luggage. This is frequently inconvenient in crowded or cramped surroundings and sometimes difficult or awkward for women to accomplish.

In view of the above, it would be desirable to have a rolling suitcase which would function as a luggage cart when needed but which would pass as an ordinary piece of luggage when not needed as a cart.

Among the several objects of the present invention may be noted the provision of a suitcase having rolling means at the bottom which is collapsed condition can be hand carried in the ordinary manner and in extended condition can be used as a luggage cart to carry other pieces of luggage. Other objects and features will be in part apparent and in part pointed out hereinafter.

The invention accordingly comprises the constructions hereinafter described, the scope of the invention being indicated in the following claims.

In the accompanying drawings, in which one of various possible embodiments of the invention is illustrated, FIG. 1 is a perspective view of a suitcase according to the present invention shown with a retractable handle and pivotal support arms in extended condition; shown in broken lines are two additional conventional suitcases;

Figure 5:
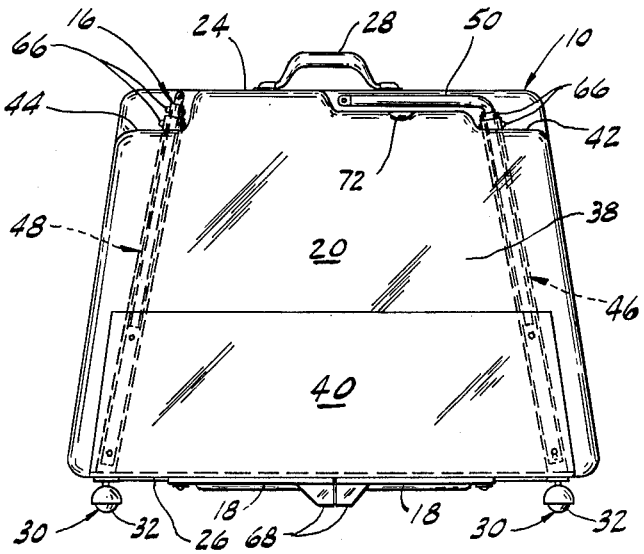
FIG. 5 is a back elevational view of the suitcase as shown in FIG. 2 except that the retractable handle is shown in collapsed condition.

Reference numeral 10 refers to a suitcase according to the present invention. In collapsed or retracted condition as shown in FIG. 5, suitcase 10 can be hand carried like an ordinary suitcase. While in extended condition, as shown in FIG. 1, it can be used to carry other pieces of luggage such as suitcases 12 and 14.

Figure 1:
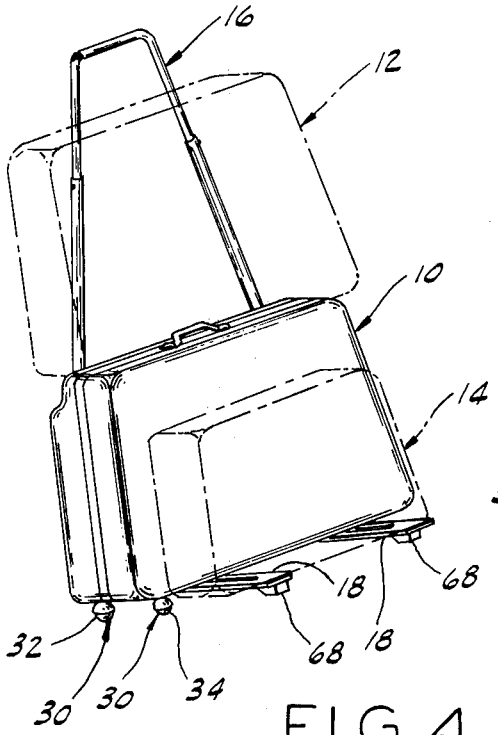

As viewed in FIG. 1, suitcase 10 includes a retractable handle 16 and a pair of pivotal arms 18. It further includes a base 20 and a lid 22. Lid 22 is attached to base 20 by hinges (not shown) and is secured with latches (not shown).

More particularly, suitcase 10 includes a top 24 and a bottom 26 formed by latched or hinged portions of base 20 and lid 22, respectively. Top 24 is outfitted with a conventional handle 28 and bottom 26 is provided with wheels 30. Suitcase 10 may be carried in the ordinary manner by handle 28 and rolled over a supporting surface on wheels 30.

Figure 2:
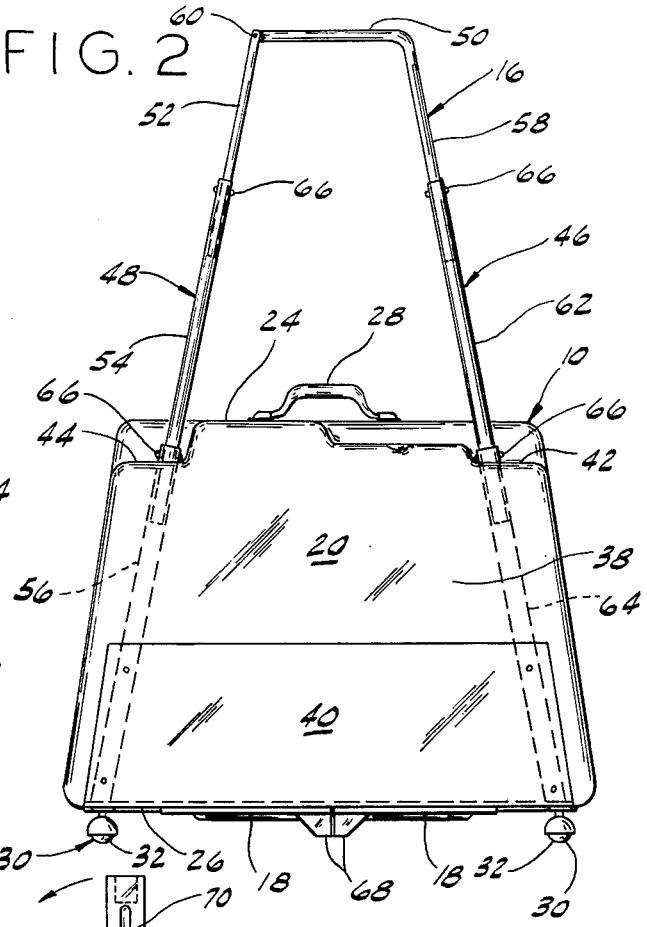
FIG. 2 is a back elevational view of the suitcase according to the present invention as shown in FIG. 1 with the retractable handle in extended condition but with the pivotal arms in retracted condition.
Figure 3:
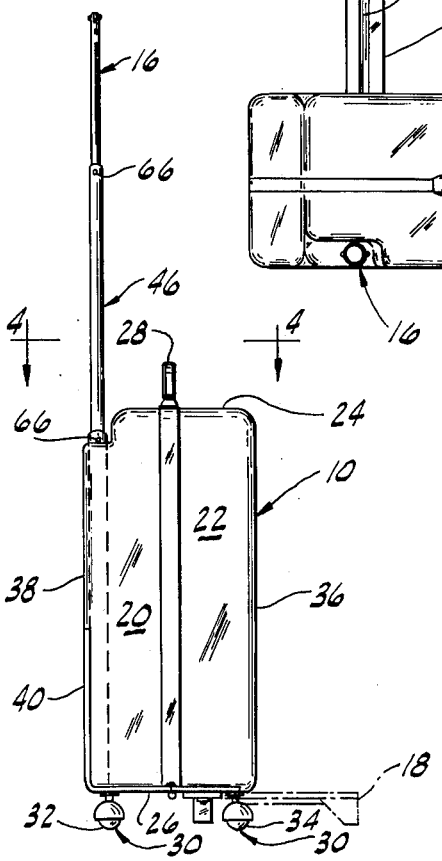
FIG. 3 is a side elevational view of the suitcases as shown in FIG. 2; shown in broken lines are the pivotal arms in extended condition.
Figure 4:
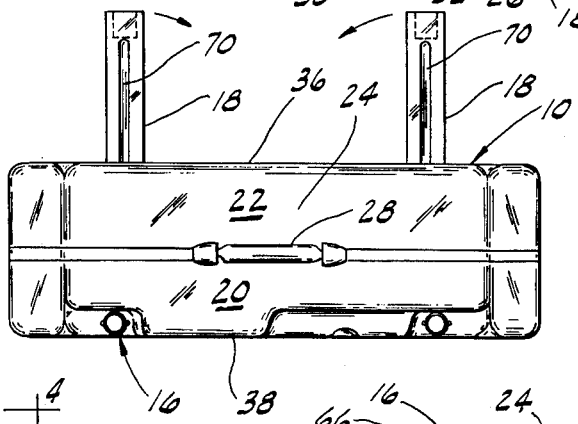
FIG. 4 is a top plan view taken along line 4—4 in FIG. 3 with the pivotal arms shown in full lines in extended condition.

Wheels 30 are arranged in first and second pairs 32 and 34, respectively, on the base and lid portions of bottom 26. Pairs 32 and 34 are positioned so that suitcase 10 is maintained in substantially upright condition on a supporting surface as best seen in FIGS. 2, 3 and 5. Pair 32 is also arranged to give rolling support to suitcase 10 when it is tipped for transport as shown in FIG. 1 and described more particularly hereinafter.

Suitcase 10 further includes a front sidewall 36 and a back sidewall 38 which is reinforced with an L-shaped plate 40 extending along the base portion of suitcase bottom 26. Back sidewall 38 has a pair of recesses 42 and 44 along its upper margin which are adapted to receive right and left portions 46 and 48, respectively, of retractable handle 16 in collapsed condition. In such condition, said handle portions are preferably maintained below the plane of suitcase top 24. As best seen in FIG. 5, right retractable handle portion 46 includes a horizontal cross-member 50 which is also received in a horizontally extending portion of recess 42 and maintained below top 24. If desired, cross-member 50, like conventional handle 28, may have finger grooves (not shown) to make it easier to grasp.

Each portion of retractable handle 16 includes two telescoping segments. Left handle portion 48 comprises a first segment 52 which may be either solid or tubular. The distal end of first segment 52 terminates in an eye (not shown) for mating engagement with right handle portion 46 as described below. The proximal end of first segment 52 is slidably received within a second segment 54, which is correspondingly slidably mounted in a tubular channel 56 in back sidewall 38.

Right handle portion 46 includes an L-shaped first segment 58 which like segment 52 may be either solid or tubular. As shown, first segment 58 includes cross-member 50 as an integral portion thereof; however, it is contemplated that segment 58 and cross-member 50 can be separately formed and appropriately joined to form said L-shaped segment. The distal end of first segment 58, shown as the distal end of cross-member 50, terminates in a pair of apertured arms (not shown) which are maintained by a pin 60 in cooperative alignment with the eye in segment 52. The proximal end of first segment 58 is slidably received until stopped by horizontal cross-member 50 within a second segment 62, which like segment 54, is slidably mounted in a tubular channel 64 in back sidewall 38. While each portion of retractable handle 16 has been described as having two telescoping segments, other numbers of segments can be used. Similarly, other means for joining left handle portion 48 and cross-member 50 are also contemplated.

Channels 56 and 64, as seen in FIG. 2, are convergingly angled towards suitcase top 24 so that horizontal cross-member 50 attached to right handle portion 46 mates with the upper end of left handle portion 48 as described above. Cross-member 50 and right and left handle portions 46 and 48 form a truncated triangle in extended condition.

As seen in FIG. 2 in broken lines, the telescoping segments of the handle portions are partially overlapped in extended condition to provide needed rigidity to the retractable handle structure. Spring biased detents 66 are provided to maintain handle portions 46 and 48 in extended position. Holes (not shown) are provided in second segments 54 and 62 and in tubular channels 56 and 64 to accommodate the detent and to afford positive locking of retractable handle 16. To this end, as retractable handle 16 is extended the detents 66 bear against the inside walls of the respective segments or channels until they reach the aforementioned holes, at which point they snap into said openings under force of said springs.

Pivotal arms 18 are attached to suitcase bottom 26 along lid 22. As shown, arms 18 are attached adjacent opposite margins and pivot inwardly towards one another. Arms 18 include feet 68 which are in the same plane as wheels 30 and provide level support therewith when arms 18 are extended or retracted position. Feet 68 also serve as brakes to prevent suitcase 10 from rolling when it is in upright rest condition as shown in FIGS. 2–5. Ribs 70 are provided as reinforcements in arms 18 and detents (not shown) are preferably provided to maintain the arms in retracted position until positively pivoted. Similarly, other detents (not shown) are preferably provided to maintain the arms in extended condition when selectively placed therein.

In use, retractable handle 16 may be elevated to its operative position by manually gripping the distal end of left handle portion 48 and pulling upward until first and second segments 52 and 54 are locked in place by detents 66. The distal end of right handle portion 46 is then grasped by cross-member 50 and similarly pulled upwardly until first and second segments 58 and 62 are locked by detents 66. Pin 60 is then inserted through the eye in first segment 52 and the apertured end of first segment 58 to join left handle portion 48 with cross-member 50. A finger recess 72 is provided in the horizontally extending portion of right recess 42, as best seen in FIG. 5, to facilitate gripping cross-member 50.

Thus extended, retractable handle 16 in combination with top 24 of suitcase 10 provides a luggage supporting surface for additional suitcase 12. If no other luggage is to be carried, suitcase 10 may be used as a luggage cart without extending pivotal arms 18. If a third suitcase such as suitcase 14 is to be carried, then arms 18 are pivoted into the position seen in FIGS. 1, 3 and 4. In which position, arms 18 provide an additional luggage supporting surface.

In other embodiments of the invention, detents are provided to maintain retractable handle portions 46 and 48 locked in retracted position until positively released. This feature is advantageous to minimize the chance of accidental entanglement of handle 16 during baggage handling. In still other embodiments, the hinge connecting lid 22 to base 20 may be a piano-type hinge for additional strength.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. In a suitcase having a bottom wall, a top wall and sidewalls, said bottom wall having rolling means and said top wall having a handle, the improvement comprising a retractable handle having a pair of longitudinally extending members connected at their proximal ends to a selected sidewall and connected at their distal ends to a cross-member forming a grip, said longitudinally extending members received in retracted condition within said selected sidewall, said improvement further including recesses in adjoining portions of the selected sidewall and the top wall for cooperative receipt of the longitudinally extending members in retracted condition so that said members are maintained in a plane below the plane of the topwall.

2. The suitcase according to claim 1 wherein the longitudinally extending members comprise telescoping tubular segments.

3. The suitcase according to claim 2 wherein the longitudinally extending members are locked in extended condition by spring biased detents.

4. The suitcase according to claim 3 wherein the cross-member is an integral portion of one of said longitudinally extending members.

5. The suitcase according to claim 1 which further includes a pair of pivotal arms attached to the bottom wall adjacent its outer margin, said arms pivoting towards each other.

6. The suitcase according to claim 5 wherein the arms include feet which are located in the same plane as the rolling means.

7. The suitcase according to claim 6 wherein the rolling means are arranged on the bottom wall so that less than all are selectively engaged when the suitcase is tipped for rolling transport by the retractable handle in extended condition.

* * * * *